US007168511B2

(12) United States Patent
Woods et al.

(10) Patent No.: US 7,168,511 B2
(45) Date of Patent: Jan. 30, 2007

(54) ROTARY DRILL BIT HAVING CUTTING INSERT WITH A NOTCH

(75) Inventors: Gerald L. Woods, Bedford, PA (US); Lynn A. Alcorn, Greensburg, PA (US)

(73) Assignee: Kennametal Inc., Latrobe, PA (US)

( * ) Notice: Subject to any disclaimer, the term of this patent is extended or adjusted under 35 U.S.C. 154(b) by 320 days.

(21) Appl. No.: 10/949,978

(22) Filed: Sep. 24, 2004

(65) Prior Publication Data

US 2006/0065446 A1 Mar. 30, 2006

(51) Int. Cl.
*E21B 10/30* (2006.01)
*E21B 10/58* (2006.01)

(52) U.S. Cl. ..... 175/420.1; 175/418; 175/427

(58) Field of Classification Search ..... None
See application file for complete search history.

(56) References Cited

U.S. PATENT DOCUMENTS

| | | | | |
|---|---|---|---|---|
| 3,595,327 | A | 7/1971 | Self | |
| 4,342,368 | A | 8/1982 | Denman | |
| 4,489,796 | A | 12/1984 | Sanchez et al. | |
| 4,527,638 | A | 7/1985 | Sanchez et al. | |
| 4,550,791 | A | 11/1985 | Isakov | |
| 4,696,352 | A | 9/1987 | Buljan et al. | |
| 4,787,464 | A | 11/1988 | Ojanen | |
| 4,817,742 | A | 4/1989 | Whysong | |
| 4,817,743 | A | 4/1989 | Greenfield et al. | |
| 5,172,775 | A | 12/1992 | Sheirer et al. | |
| 5,184,689 | A | 2/1993 | Sheirer et al. | |
| 5,297,643 | A | 3/1994 | Montgomery, Jr. et al. | |
| 5,311,959 | A | 5/1994 | Adams | |
| 5,429,199 | A | 7/1995 | Sheirer et al. | |
| 5,467,837 | A | 11/1995 | Miller et al. | |
| 5,829,540 | A | 11/1998 | Peay et al. | |
| 5,996,715 | A * | 12/1999 | Peay et al. | 175/420.1 |
| 6,044,920 | A | 4/2000 | Massa et al. | |
| 6,109,377 | A | 8/2000 | Massa et al. | |
| 6,176,332 | B1 | 1/2001 | Massa et al. | |
| 6,315,064 | B1 | 11/2001 | Massa et al. | |
| 6,595,305 | B1 | 7/2003 | Dunn et al. | |
| 6,915,867 | B2 * | 7/2005 | Bise | 175/420.1 |
| 6,945,340 | B2 * | 9/2005 | Bise et al. | 175/430 |

OTHER PUBLICATIONS

Kennametal Catalog, "Cutting And Drilling Systems . . . For Underground and Surface Mining," B00-023(10)JO.

* cited by examiner

*Primary Examiner*—Frank Tsay
(74) *Attorney, Agent, or Firm*—Matthew W. Smith

(57) ABSTRACT

A rotary drill bit insert that includes an elongate body that is rotatable about a central axis wherein the elongate body has a pair of symmetrical halves symmetrical about the central axis. The elongate body contains a central notch disposed between the symmetric halves of the elongate body. Each symmetrical half includes a leading face and a top surface that has a leading surface and a trailing relief surface wherein the leading surface and the trailing relief surface are contiguous and non-coplanar. Each half also has a leading cutting edge at the intersection of the leading face and the leading surface of the top surface. The leading surface is inclined at a constant angle of inclination in a radial direction with respect to a first radial line projecting from the central axis, and the leading surface being inclined downwardly and rearwardly from the leading cutting edge.

28 Claims, 4 Drawing Sheets

ROTARY DRILL BIT HAVING CUTTING INSERT WITH A NOTCH

BACKGROUND OF THE INVENTION

The invention pertains to an excavating tool such as, for example, a rotary drill bit, including the cutting insert therefor, and a method of drilling using the rotary drill bit, wherein the bit is useful for drilling through various earth strata. More specifically, the invention pertains to a roof drill bit, including the cutting insert therefor, and a method for using the roof drill bit, wherein the bit is useful for drilling bore holes in an underground mine.

The expansion of an underground mine, such as for example, a coal mine, requires digging a tunnel. Initially, this tunnel has an unsupported roof. Because the roof is not supported, there is an increased chance for a mine cave that, of course, adds to the hazards of underground coal mining. Furthermore, an unsupported roof is susceptible to rock and debris falling from the roof. Falling rock and debris can injure workers as well as create hazardous clutter on the floor of the tunnel.

In order to support and stabilize the roof in an underground tunnel, bore holes are drilled in the roof, i.e., earth strata. The apparatus used to drill these holes comprises a drill with a long shaft, i.e., drill steel, attached to the drill. A roof bit is detachably mounted to the drill steel at the distal end thereof. The roof bit is then pressed against the roof, and the drilling apparatus operated so as to drill a bore hole in the roof. The bore holes extend between about two feet and about twenty feet into the roof depending upon the particular situation. The typical rate of rotation is between about 100 revolutions per minute (rpm) to about 800 rpm, and the typical thrust is between about 1000 pounds to about 10,000 pounds for a time sufficient to drill the desired hole in the earth strata.

Roof support members, such as roof panels, are then attached to roof bolts. In one alternative procedure, these bore holes are filled with resin and roof bolts are fixed within the bore holes. In another alternative procedure, the roof bolts use mechanical expander shells to affix the roof bolts in the bore holes. The end result of using either procedure is a roof which is supported, and hence, is of much greater stability than the unsupported roof. This reduces the hazards associated with underground mining. The roof bolting process is considered to be an essential underground mining activity.

Roof bolting accounts for the largest number of lost time injuries in underground mining. During the roof bolting process, the roof is unsupported so that it does not have optimum stability. Furthermore, the roof bolting process exerts stresses on the roof so as to further increase the safety hazards during the roof bolting process. Thus, a decrease in the overall time necessary to bore holes reduces the time it takes to complete the roof bolting process. This is desirable since it contributes to the overall speed, efficiency and safety of the roof bolting process.

While there may be additional ways to decrease the overall time to complete the drilling of the necessary bore holes, one way is to use a roof drill bit that has a longer useful life so as to decrease the number times a roof drill bit must be replaced during the roof bolting process. Another way to decrease the overall time to complete the roof bolting process is to use a roof drill bit that drills the boreholes faster.

A roof drill bit typically comprises a steel bit body that attaches to a drill steel. The bit body has an axial forward end to which a cutting insert is affixed typically by brazing. The cutting insert is the component of the roof drill bit that typically has the greatest impact on the useful life of the roof drill bit and on the speed at which the roof drill bit drills holes.

Hence, heretofore, persons have developed cutting inserts for roof drill bits wherein the cutting inserts had various geometries. For example, U.S. Pat. No. 4,342,368 to Denman discloses a cutting insert for a roof drill bit. This cutting insert has a leading face and a frontal face that intersect to form a cutting edge. This cutting insert further includes a cut-out.

As another example, U.S. Pat. No. 4,787,464 to Ojanen discloses a cutting insert for a roof drill bit. This cutting insert has a leading face inclined at a constant angle with respect to the axis of rotation. The cutting insert also has a frontal face with a variable relief angle decreasing with increasing radial distance from the axis at its radial distal edge.

As still another example for a cutting insert for a roof drill bit, U.S. Pat. No. 6,595,305 to Dunn et al., shows a roof drill bit that has a cutting insert at the axial forward end thereof. The cutting insert has a trio of cutting edges.

In severe drilling conditions or in laminated geological conditions, a roof drill bit that uses a thicker cutting insert (e.g., a cutting insert that has a thickness equal to about 0.250 inches (6.35 millimeters)) typically will exhibit less breakage as compared to a roof drill bit that uses a thinner cutting insert (e.g., a cutting insert that has a thickness equal to about 0.180 inches (4.57 millimeters)). A roof drill bit that uses a thicker cutting insert will provide one way to decrease the overall time to complete the roof bolting process in view of the reduction in the occurrences of breakages. However, the use of a roof drill bit that uses a thicker cutting insert typically experiences a reduction in the penetration rate, and hence, while there is a decrease in the breakage of the cutting inserts, there is a corresponding reduction in the overall drilling speed.

It therefore becomes apparent that it would be desirable to provide an improved roof drill bit that facilitates the prompt completion of the roof bolting process. It is also apparent that it would be desirable to provide an improved roof drill bit that has a longer useful life. It is further apparent that it would be desirable to provide an improved roof drill bit that has an increased penetration rate. Finally, it is apparent that it would be desirable to provide an improved roof drill bit that has both a longer useful life and an increased penetration rate.

SUMMARY OF THE INVENTION

In one form thereof, the invention is a rotary drill bit insert that includes an elongate body that is rotatable about a central axis wherein the elongate body has a pair of symmetrical halves symmetrical about the central axis. The elongate body contains a central notch disposed between the symmetric halves of the elongate body. Each symmetrical half comprises a leading face and a top surface. The top surface has a leading surface and a trailing relief surface wherein the leading surface and the trailing relief surface are contiguous and non-coplanar. There is a leading cutting edge at the intersection of the leading face and the leading surface of the top surface. The leading surface is inclined at a constant angle of inclination in a radial direction with respect to a first radial line projecting from the central axis, and the leading surface being inclined downwardly and rearwardly from the leading cutting edge.

In still another form thereof, the invention is a rotary drill bit that comprises an elongate drill bit body that has an axial forward surface that has attached thereto a rotary drill bit insert. The rotary drill bit insert comprises an elongate body that is rotatable about a central axis wherein the elongate body has a pair of symmetrical halves symmetrical about the central axis. The elongate body contains a central notch disposed between the symmetric halves of the elongate body. Each symmetrical half comprises a leading face and a top surface. The top surface has a leading surface and a trailing relief surface wherein the leading surface and the trailing relief surface are contiguous and non-coplanar. There is a leading cutting edge at the intersection of the leading face and the leading surface of the top surface. The leading surface is inclined at a constant angle of inclination in a radial direction with respect to a first radial line projecting from the central axis, and the leading surface being inclined downwardly and rearwardly from the leading cutting edge.

In still another form thereof, the invention is a rotary drill bit insert that includes an elongate body rotatable about a central axis. The elongate body has a pair of symmetrical halves symmetrical about the central axis. The elongate body contains a central notch disposed between the symmetric halves of the elongate body. Each symmetrical half comprises a leading face, a top surface, and a leading cutting edge at the intersection of the leading face and the top surface. The top surface is inclined in the radial direction from the central axis at a variable angle of inclination with respect to a second line normal to both a first radial line projecting from the central axis and the central axis.

In yet another form thereof, the invention is a rotary drill bit that includes an elongate drill bit body that has an axial forward end that has having attached thereto a rotary drill bit insert. The rotary drill bit insert comprises an elongate body rotatable about a central axis. The elongate body has a pair of symmetrical halves symmetrical about the central axis. The elongate body contains a central notch disposed between the symmetric halves of the elongate body. Each symmetrical half comprises a leading face and a top surface. There is a leading cutting edge at the intersection of the leading face and the top surface. The top surface is inclined in the radial direction from the central axis at a variable angle of inclination with respect to a second line normal to both a first radial line projecting from the central axis and the central axis.

BRIEF DESCRIPTION OF THE DRAWINGS

The following is a brief description of the drawings that form a part of this patent application.

DETAILED DESCRIPTION OF THE INVENTION

Figure 1:
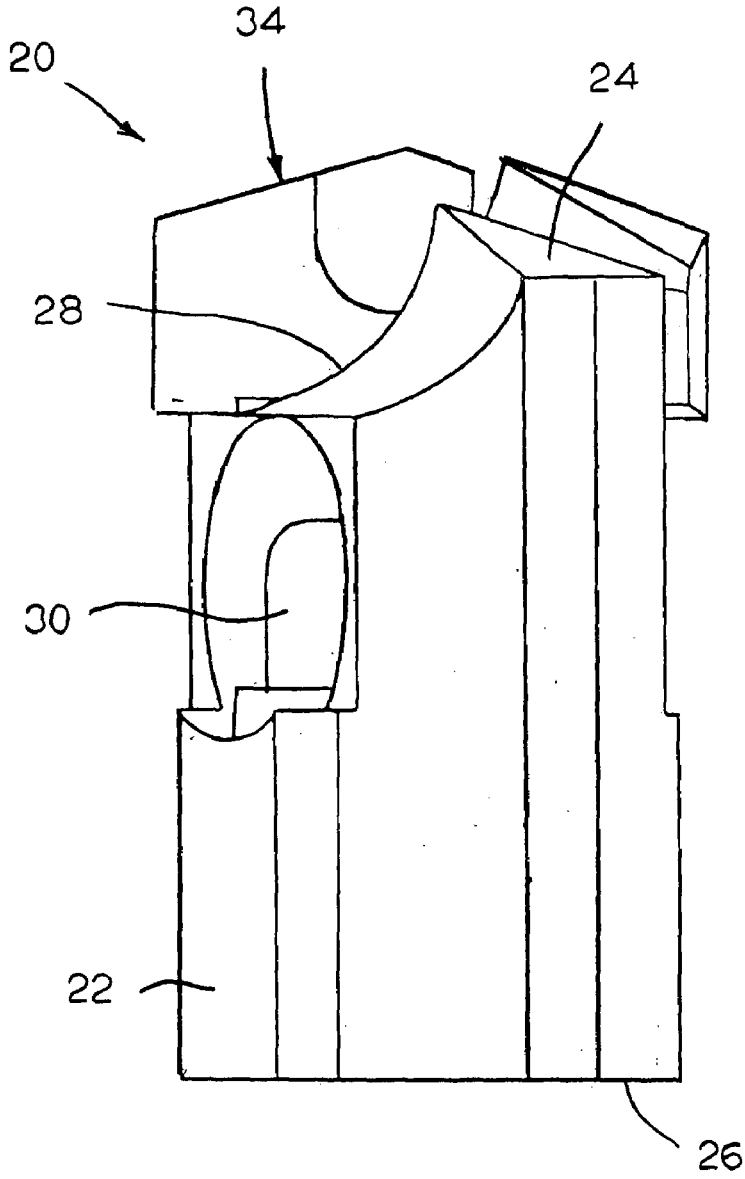
FIG. 1 is a side view of a rotary drill bit that includes a drill bit body that has a brazed-in cutting insert.

Referring to the drawings, FIG. 1 illustrates a rotary drill bit in the form of a roof drill bit generally designated as 20. Roof drill bit 20 has an elongate bit body 22 typically made of steel. Elongate bit body 22 presents a generally cylindrical geometry. Drill bit body 22 has an axial forward end 24 and an axial rearward end 26. Drill bit body 22 contains a transverse slot 28 in the axial forward end thereof 24. Drill bit body 22 also contains a dust collection opening 30 that is mediate between the axial forward end 24 and the axial rearward end 26. During the drilling operation, dirt and debris may pass through the opening 30. A cutting insert (or rotary drill bit insert) 34 is positioned within the transverse slot 28 and is typically affixed therein by brazing.

The cutting insert 34 is typically made from cemented tungsten carbide that is a mixture of cobalt and tungsten carbide. U.S. Pat. No. 5,467,837 to Miller et al. (assigned to the assignee of the present patent application) presents some cemented (cobalt) tungsten carbide compositions for cutting inserts for roof drill bits. U.S. Pat. No. 5,467,837 to Miller et al. is hereby incorporated by reference herein.

More specifically, the cemented tungsten carbide preferably contains between about 5 weight percent to about 15 weight percent cobalt with the balance tungsten carbide. The grain size of the tungsten carbide may vary in size. For example, the grain size of the tungsten carbide grains may vary from about 1 micrometer to about 18 micrometers. The preferred grade of cemented tungsten carbide varies with the particular application. The following grades of cemented tungsten carbide are typical for use as a cutting insert in a rotary drill bit. Grade No. 1 has a tungsten carbide grain size within a range of about 1 micrometers to about 18 micrometers, a nominal cobalt content of about 5.7 weight percent and a nominal hardness on the Rockwell "A" scale of 88.3. Grade No. 2 has a tungsten carbide grain size that is within a range of about 1 micrometers to about 9 micrometers, a nominal cobalt content of about 6.0 weight percent, and a nominal hardness on the Rockwell "A" scale of 90.4. Grade No. 3 has a WC grain size that is within a range of about 1 micrometer to about 15 micrometers, a nominal cobalt content of about 5.6 weight percent, and a nominal hardness on the Rockwell "A" scale of 89.4. Grade No. 4 has a nominal cobalt content of 6.0 weight percent and a nominal hardness on the Rockwell "A" scale of 89.6. It should be appreciated that a coated cutting insert may be useful. In this regard, one such cutting insert is a polycrystalline diamond cutting insert that comprises a cemented tungsten carbide substrate that has one or more polycrystalline diamond layers such as that shown in U.S. Pat. No. 5,429,199 to Sheirer et al., for a "Cutting Bit and Cutting Insert", and owned by the assignee of this patent application. This patent is hereby incorporated by reference herein.

One preferred braze alloy is HANDY HI-TEMP 548 braze alloy, manufactured and sold by Handy & Harmon, Inc., 859 Third Avenue, New York, N.Y. 10022. HANDY HI-TEMP 548 braze alloy has a nominal composition (in weight percent) of 54.0–56.0% copper; 5.5–6.5% nickel; 3.5–4.5% manganese; 0.01–0.40% silicon; the balance is zinc except for a maximum content of other elements equal to 0.50 weight percent.

One preferred way to use this braze alloy is in the form of a shim that is used in conjunction with a perforated steel shim. U.S. Pat. No. 4,817,742, to Whysong and U.S. Pat. No. 4,817,743, to Greenfield et al., all of which are owned by the assignee of the present patent application, disclose exemplary brazing arrangements. Each one of these patents is hereby incorporated by reference herein.

Cutting insert 34 has a cutting insert body generally designated as 36 that has a top surface generally designated (in FIG. 2) as 38, a bottom surface generally designated as 40, opposite side surfaces generally designated (in FIG. 2) as 42 and 44, and opposite edge surfaces generally designated (in FIG. 2) as 46 and 48. Cutting insert body 36 contains a centrally-located U-shaped notch (or central notch) 50 therein. The U-shaped notch 50 essentially divides the cutting insert body 36 into two opposite symmetric connected portions that are symmetric about the central axis A—A; namely, one symmetric portion designated by brackets 54 (see FIG. 3) and another symmetric portion designated by brackets 56 (see FIG. 3). At least in some aspects, the cutting insert 36 presents a geometry along the lines of the geometry of the cutting insert shown in FIG. 22 of U.S. Pat. No. 5,172,775 to Sheirer et al. (assigned to the assignee of the present patent application). U.S. Pat. No. 5,172,775 to Sheirer et al. is hereby incorporated by reference herein.

Figure 2:
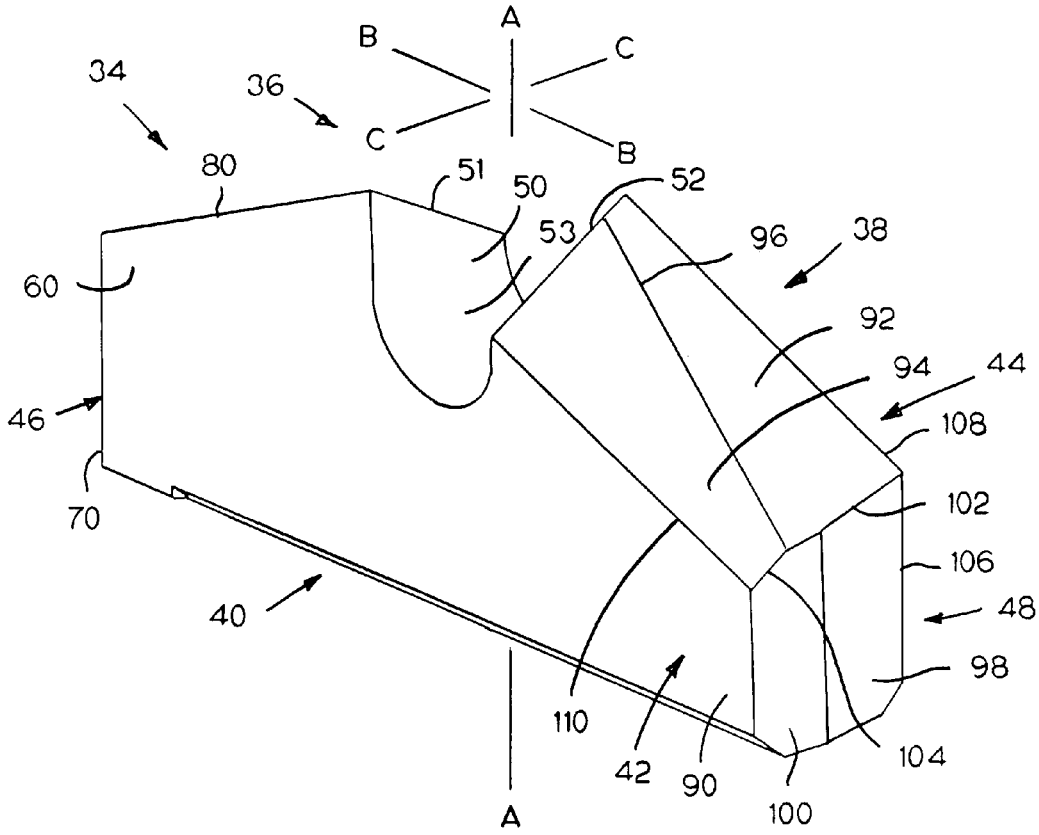
FIG. 2 is an isometric view at one orientation of the cutting insert shown in FIG. 1.
Figure 3:
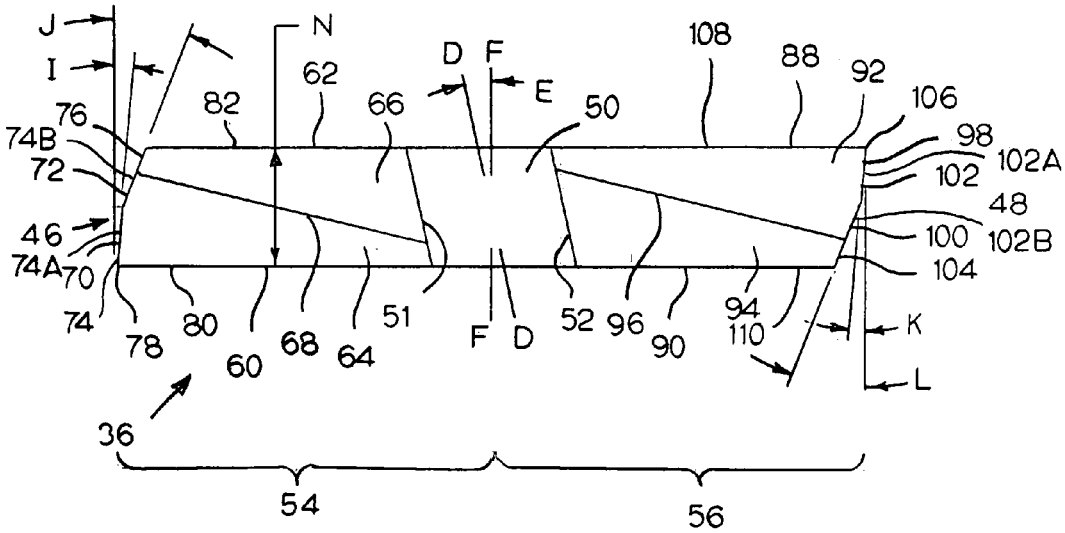
FIG. 3 is a top view of the cutting insert of FIG. 2.

As shown in FIG. 2, cutting insert 36 has a central axis A—A wherein the cutting insert 36 is rotatable about the central axis A—A. There is a first radial line B-B that projects in a radial outward direction from the central axis A—A. There is a second line C—C that passes through the central axis A—A and is normal to the first radial line B—B. As shown in FIG. 3, the cutting insert 36 has a thickness "N". Preferably, the thickness "N" is equal to about 0.250 inches.

U-shaped notch 50 has opposite edges 51 and 52 that define the opposite terminations of the notch 50. Notch 50 further includes a U-shaped surface 53. As particularly shown in FIG. 3, the U-shaped notch 50 presents an orientation so that the horizontal central axis (D—D) thereof is disposed at an acute angle "E" with respect to a line (F—F) that is normal to the sides (42 and 44) of the cutting insert body 36. Angle E may range between about 0° and about 45°. One preferred magnitude of angle E is equal to about 5°.

Referring to the one symmetric portion 54, there is a leading face 60 and an opposite trailing face 62 (see FIG. 3). The top surface 38 comprises a leading top surface 64 and a trailing relief surface 66. The leading top surface 64 and the trailing relief surface 66 are contiguous and non-coplanar. The leading top surface 64 and the trailing relief surface 66 intersect to form a top apex 68 that extends along the length of the one symmetric portion 54 from the edge 51 of the notch 50 to the one edge 46.

Figure 4:
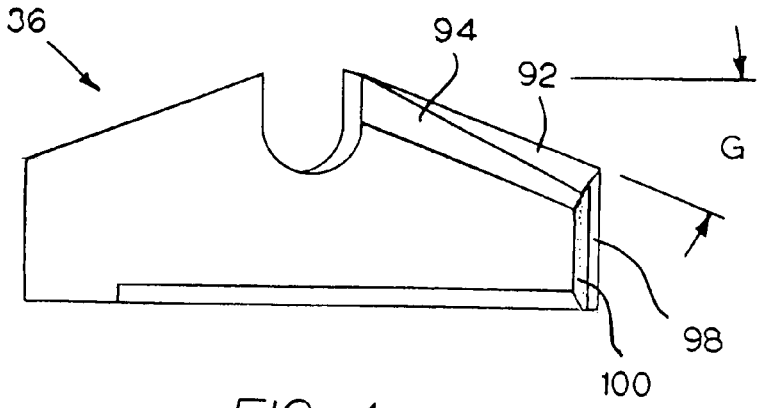
FIG. 4 is a front view of the cutting insert of FIG. 2.
Figure 6:
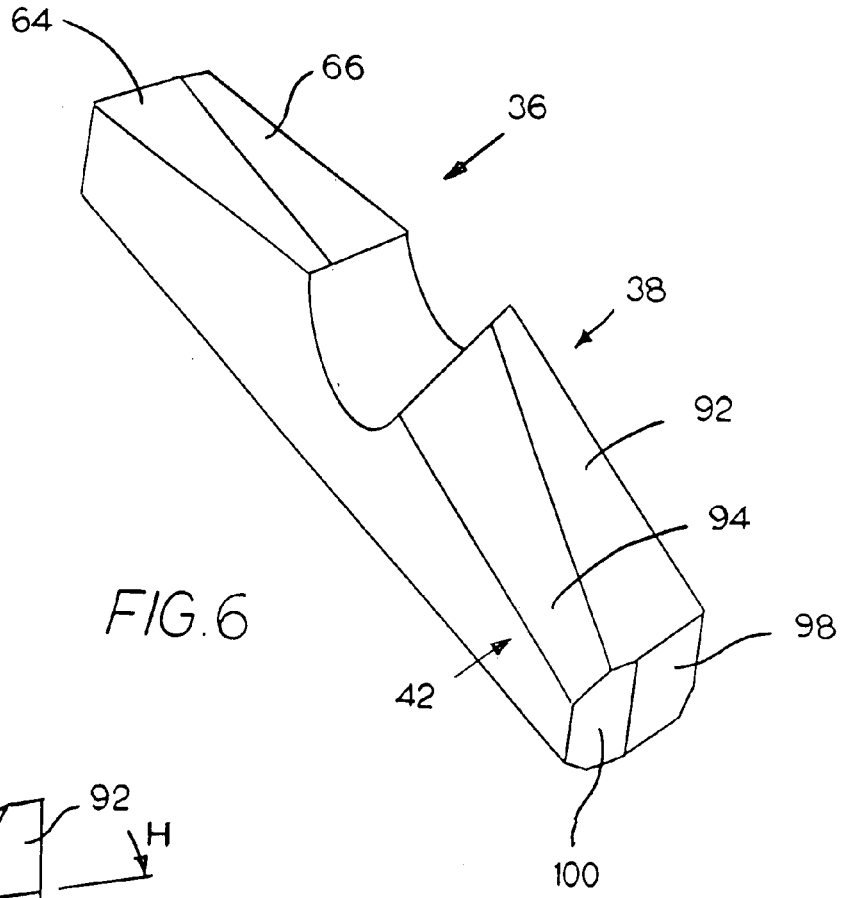
FIG. 6 is an isometric view at another orientation of the cutting insert of FIG. 1.
Figure 5:
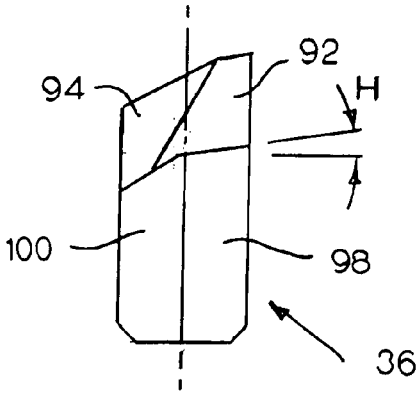
FIG. 5 is a side view of the cutting insert of FIG. 2.

As will be described in more detail with respect to the other symmetric portion 56, the leading top surface 64 is inclined at a constant angle of inclination (see angle G in FIG. 4) with respect to the first radial line B—B that projects from the central axis A—A. Leading top surface 64 is also inclined at a constant angle of inclination (see angle H in FIG. 5) with respect to the second line C—C normal to the radial line B—B. The trailing relief surface 66 is oriented at an angle with respect to the leading top surface 64. In this regard, the trailing relief surface 66 is inclined in the radial direction from the central axis A—A at a variable angle of inclination with respect to the second line C—C.

The one edge 46 has a leading edge portion 70 and a trailing edge portion 72. The leading edge portion 70 and the trailing edge portion 72 are contiguous to each other. The leading edge portion 70 has an orientation so that it is disposed at an acute angle "I" with respect to a line that is normal to the leading face 60. Angle "I" can range between about 0° and about 10°. One preferred angle I is equal to about 5°. The trailing edge portion 72 has an orientation so that it is disposed at an acute angle "J" with respect to a line that is normal to the leading face 60. Angle "J" can range between about 5° and about 45°. One preferred angle J is equal to about 22°.

The leading top surface 64 intersects with the leading edge portion 70 and a portion of the trailing edge portion 72 to form a leading corner 74 that has a leading portion 74A defined by the intersection of the leading top surface 64 and the leading edge portion 70 and a trailing portion 74B defined by the intersection of the leading top surface 64 with a portion of the trailing edge portion 72. The trailing top surface 66 intersects with a portion of the trailing edge portion 72 to form the trailing corner 76. A side clearance edge 78 is at the intersection between the leading face 60 and the leading edge portion 70. A leading cutting edge 80 is at the intersection between the leading face 60 and the leading top surface 64. A trailing edge 82 is at the intersection between the trailing face 62 and the trailing relief surface 66.

The leading top surface 64 defines a five-sided (i.e., pentagonal-shaped) generally planar surface wherein none of the sides are parallel to each other. More specifically, these sides are: the top apex 68, a portion of the edge 51 of the U-shaped notch 50, the leading cutting edge 80, the leading portion 74A and the trailing portion 74B of the leading edge portion 74. These sides define the leading top surface 64. The trailing relief surface 66 defines a four-sided generally planar surface wherein none of the sides are parallel to each other, i.e., a trapezium-shaped surface. More specifically, the top apex 68, a portion of the edge 51 of the U-shaped notch 50, the trailing edge 82 and the trailing corner 76 define the trailing relief surface 66.

Referring to the other symmetric portion 56, there is a leading face 88 and an opposite trailing face 90. The top surface 38 comprises a leading top surface 92 and a trailing relief surface 94. The leading top surface 92 and the trailing relief surface 94 intersect to form a top apex 96 that extends along the length of the one symmetric portion 56 from the edge 52 of the notch 50 to the one edge 48.

The one edge 48 has a leading edge portion 98 and a trailing edge portion 100. The leading edge portion 98 and the trailing edge portion 100 are contiguous to each other. The leading edge portion 98 has an orientation so that it is disposed at an acute angle "K" with respect to a line that is normal to the leading face 88. Angle "K" can range between about 0° and about 10°. One preferred angle K is equal to about 5°. The trailing edge portion 100 has an orientation so that it is disposed at an acute angle "L" with respect to a line that is normal to the leading face 88. Angle "L" can range between about 5° and about 45°. One preferred angle L is equal to about 22°.

The leading top surface 92 intersects with the leading edge portion 98 and a portion of the trailing edge portion 100 to form a leading corner 102 that has a leading portion 102A defined by the intersection of the leading top surface 92 with the leading edge portion 98 and a trailing portion 102B defined by the intersection of the leading top surface 92 with a portion of the trailing edge portion 100. The trailing relief surface 94 intersects with a portion of the trailing edge portion 100 to form the trailing corner 104. A side clearance edge 106 is at the intersection between the leading face 88 and the leading edge portion 98. A leading cutting edge 108 is at the intersection between the leading face 88 and the leading top surface 92. A trailing edge 110 is at the intersection between the trailing face 90 and the trailing relief surface 94.

The leading top surface 92 defines a five-sided (pentagon-shaped) generally planar surface wherein none of the sides are parallel to each other. More specifically, these sides are: the top apex 96, a portion of the edge 52 of the U-shaped notch 50, the leading cutting edge 108 and the leading portion 102A and the trailing portion 102B of the leading edge portion 102. These sides define the leading top surface 92. The trailing relief surface 94 defines a four-sided generally planar surface wherein none of the sides are parallel to each other, i.e., a trapezium-shaped surface. More specifically, the top apex 96, a portion of the edge 52 of the U-shaped notch 50, the trailing edge 110 and the trailing corner 104 define the trailing relief surface 94.

Leading top surface 92 is inclined at an angle of inclination G (see FIG. 4) with respect to a radial line B—B that projects from the central axis A—A and at a constant angle of inclination H (see FIG. 5) with respect to line C—C that is a second line that is normal to the radial line B—B. Angle G ranges between about 10° and about 40° with a narrow range being between about 20° and about 35°, and with the most preferred angle G equal to about 22°. Angle H ranges between about 10° and about 35°, and with the most preferred angle H equal to about 22°.

Trailing relief surface 94 has an orientation with respect to the leading top surface 92. In this regard, the trailing relief surface 94 is disposed at an angle equal to about 18° with respect to the first radial line B—B and is disposed at a variable angle with respect to line C—C wherein the angle depends on a chord of a radius not parallel to line B—B.

Figure 7:
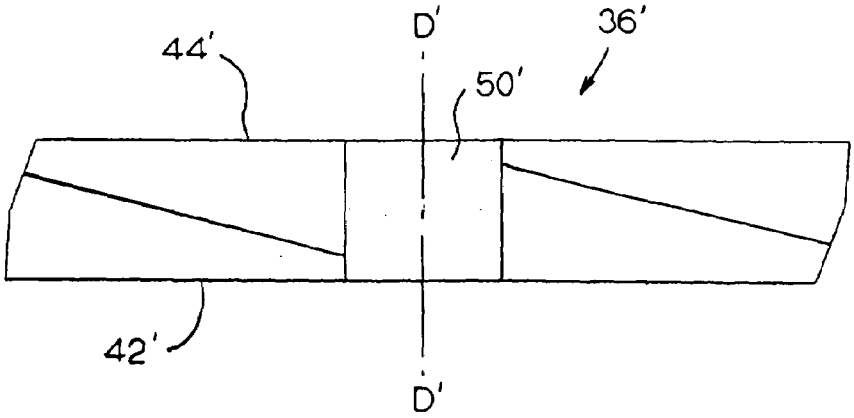
FIG. 7 is a top view of another specific embodiment of a cutting insert.

Referring to FIG. 7., there is shown another embodiment of a cutting insert 36'. The structure of this embodiment of a cutting insert 36' is along the lines of the geometry of the cutting insert 36. The difference between cutting insert 36 and cutting insert 36' is that in cutting insert 36', the notch 50' has an orientation so that the horizontal central axis (D'–D') is perpendicular to the opposite side surfaces 42' and 44'.

Figure 8:
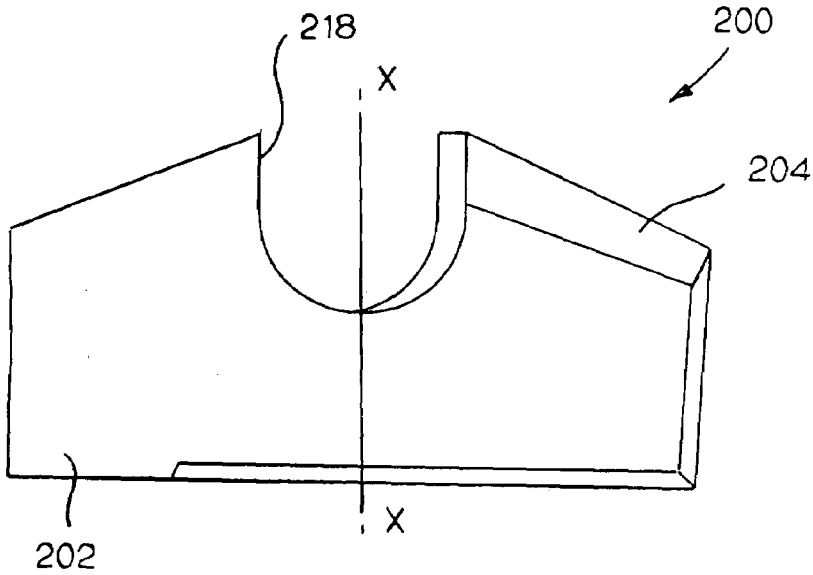
FIG. 8 is a front view of another specific embodiment of a cutting insert.
Figure 9:
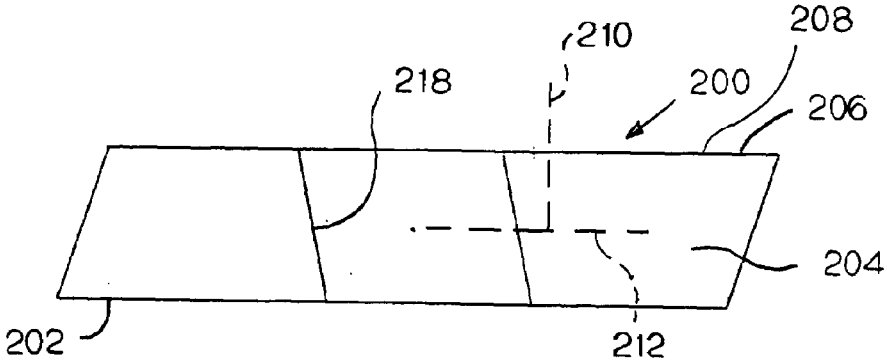
FIG. 9 is a top view of the cutting insert of FIG. 9.

In reference to FIGS. 8 and 9, it should also be appreciated that another specific embodiment of the cutting insert 200 presents a geometry along the lines of the geometry shown in U.S. Pat. No. 4,787,464 to Ojanen (U.S. Pat. No. 4,787,464 to Ojanen is hereby incorporated by reference herein), except that the cutting insert 200 has a central notch 218 therein. Cutting insert 200 has a cutting insert body 202 that is rotatable about its central axis X—X and is symmetrical thereabout. Each symmetrical portion of half on opposing sides of axis X—X includes a top surface 204 that intersects a leading face 206 to form a cutting edge 208. The top surface 204 has an angle of inclination with respect to line 210 (a line that is normal to both axis X—X and to radial line 212) that decreases with radial distance from axis X—X.

Along the line described in U.S. Pat. No. 4,787,464 to Ojanen, the angle of inclination of the top surface 204 decreases with radial distance away from the central axis X—X. At the point nearest to the central axis X—X, the angle of inclination can range between about 25 degrees to about 55 degrees. At the radial distal end of the cutting insert, the angle of inclination may range between about 15 degrees and about 25 degrees.

Tests were conducted to compare the performance of the inventive roof drill bit against two comparative standard prior art roof drill bits. One comparative roof drill bit, i.e., Comp. Nos. 1A and 1B, used in the comparative testing was a standard SV119 roof drill bit made and sold by Kennametal Inc. of Latrobe, Pa. 15650 wherein this SV119 roof drill bit contained a central notch and a standard 21 degree relief angle. The other comparative roof drill bit, i.e., Comp. Nos. 2A and 2B, was a standard Model RRWT roof drill bit made and sold by Kennametal Inc. wherein the RRWT roof drill bit contained a thick (i.e., a thickness equal to 0.250 inches) cutting insert that had fluted relief angle, but no central notch. The inventive roof drill bits (No. 3A and No. 3B) for the testing used a cutting insert that had both a central notch and a fluted cutting angle like that shown in FIG. 2 hereof.

The tests were conducted in a laboratory environment by drilling into a block of Barre granite without any coolant (i.e., dry) with a thrust equal to 5760 pounds and at a speed equal to 300 revolutions per minute (RPM). The results of these tests are set forth below in Table 1. Two tests were performed for each type of roof drill bit. For each one of the tests, Table 1 sets forth the depth that the roof drill bit drilled as measured in inches, and the time that it took to drill the hole as measured in seconds. Table 1 then sets forth the average distance drilled as measured in inches, the average drilling time as measured in seconds, and the average penetration rate as measured in inches per second.

TABLE 1

Results of Comparative Drilling Tests in Barre Granite at a Thrust of 5760 Pounds and a Speed of 300 RPM

| Roof Drill Bit | Distance Drilled (inches) | Drilling Time (seconds) | Average Distance Drilled (inches) | Average Drilling Time (seconds) | Average Penetration Rate (in/sec) |
|---|---|---|---|---|---|
| Comp. No. 1A | 28.36329 | 102 | — | — | — |
| Comp. No. 1B | 27.9873 | 95.25 | — | — | — |
| Avg Comp. Nos. 1A & 1B | — | — | 28.175295 | 98.625 | 0.286 |
| Comp. No. 2A | 28.07488 | 96.25 | — | — | — |
| Comp. No. 2B | 28.3168 | 93.75 | — | — | — |
| Avg for Comp. Nos. 2A & 2B | — | — | 28.19584 | 95 | 0.297 |
| Inv. No. 3A | 27.89782 | 87.5 | — | — | — |
| Inv. No. 3B | 27.62422 | 80 | — | — | — |
| Avg for Inv. Nos. 3A & 3B | — | — | 27.76102 | 83.75 | 0.331 |

The test results show that for drilling in Barre granite at a thrust equal to 5760 pounds and at a speed equal to 300 RPM, the inventive roof drill bit (Inv. Nos. 3A and 3B) had a drilling rate about 15.9 percent faster than the drilling rate for the SV119 roof drill bit (Comp. Nos. 1A and 1B) and about 11.5 percent faster than the RRWT roof drill bit (Comp. Nos. 2A and 2B). These results demonstrate the improvement in the drilling rate that has been achieved by the present invention.

The patents and other documents identified herein are hereby incorporated by reference herein. Other embodiments of the invention will be apparent to those skilled in the art from a consideration of the specification or a practice of the invention disclosed herein. It is intended that the specification and examples are illustrative only and are not intended to be limiting on the scope of the invention. The true scope and spirit of the invention is indicated by the following claims.

What is claimed is:

1. A rotary drill bit insert comprising:

an elongate body rotatable about a central axis, the elongate body having a pair of symmetrical halves symmetrical about the central axis;

the elongate body containing a central notch disposed between the symmetric halves of the elongate body; and each symmetrical half comprising:

a leading face;

a top surface having a leading surface and a trailing relief surface wherein the leading surface and the trailing relief surface being contiguous and non-coplanar;

a leading cutting edge at the intersection of the leading face and the leading surface of the top surface; and the leading surface being inclined at a constant angle of inclination in a radial direction with respect to a first radial line projecting from the central axis, and the leading surface being inclined downwardly and rearwardly from the leading cutting edge.

2. The rotary drill bit insert of claim 1 wherein the leading surface being inclined at a constant angle of inclination with respect to a second line normal to the first radial line and to the central axis.

3. The rotary drill bit insert of claim 2 wherein said trailing relief surface being inclined in the radial direction from the central axis at a variable angle of inclination with respect to the second line.

4. The rotary drill bit insert as set forth in claim 2 wherein said angle of inclination of the leading surface with respect to the second line ranges between about 10 degrees and about 35 degrees.

5. The rotary drill bit insert as set forth in claim 4 wherein said angle of inclination of said front surface with respect to said second line is approximately 22 degrees.

6. The rotary drill bit insert of claim 1 wherein the leading surface is pentagon-shaped.

7. The rotary drill bit insert as set forth in claim 1 wherein the trailing relief surface is trapezium shaped.

8. The rotary drill bit insert of claim 1 wherein the juncture between the leading surface and the trailing relief surface defines atop apex, and the top apex in a radial direction away from the central axis moving away from the leading cutting edge.

9. The rotary drill bit insert as set forth in claim 1 wherein the trailing relief surface is generally planar.

10. The rotary drill bit insert as set forth in claim 1 wherein each one of the symmetric halves further including a trailing face and a distal edge, and the distal edge being inclined rearwardly and inwardly toward the trailing face.

11. The rotary drill bit insert of claim 10 wherein the distal edge has a leading edge portion that is inclined rearwardly and inwardly toward the trailing face at a first angle of inclination and has a trailing edge portion that is inclined rearwardly and inwardly toward the trailing face at a second angle of inclination.

12. The rotary drill bit insert of claim 11 wherein the second angle of inclination is greater than the first angle of inclination.

13. A rotary drill bit comprising:

an elongate drill bit body having an axial forward end having attached thereto a rotary drill bit insert; and the rotary drill bit insert comprising:

an elongate body rotatable about a central axis, the elongate body having a pair of symmetrical halves symmetrical about the central axis;

the elongate body containing a central notch disposed between the symmetric halves of the elongate body; and each symmetrical half comprising:

a leading face;

a top surface having a leading surface and a trailing relief surface wherein the leading surface and the trailing relief surface being contiguous and non-coplanar;

a leading cutting edge at the intersection of the leading face and the leading surface of the top surface;

the leading surface being inclined at a constant angle of inclination in a radial direction with respect to a first radial line projecting from the central axis, and the leading surface being inclined downwardly and rearwardly from the leading cutting edge.

14. The rotary drill bit of claim 13 wherein the leading cutting edge being inclined at a constant angle of inclination with respect to a second line normal to the first radial line and to the central axis.

15. The rotary drill bit of claim 14 wherein said trailing relief surface being inclined in the radial direction from the central axis at a variable angle of inclination with respect to the second line.

16. The rotary drill bit of claim 14 wherein said angle of inclination of said front surface with respect to said second line ranges between about 10 degrees and about 55 degrees.

17. The rotary drill bit of claim 13 wherein said angle of inclination of said front surface with respect to said second line is approximately 22 degrees.

18. The rotary drill bit of claim 13 wherein the leading surface is inclined with radial distance from said central axis at a constant angle of inclination with respect to a first radial line projecting from the central axis and inclined at a constant angle of inclination with respect to a second line normal to said radial line.

19. The rotary drill bit of claim 13 wherein the leading surface is trapezium shaped.

20. The rotary drill bit of claim 13 wherein the trailing relief surface is pentagon-shaped.

21. The rotary drill bit of claim 13 wherein the trailing relief surface is generally planar.

22. The rotary drill bit of claim 13 wherein each one of the symmetric halves including a trailing face and a distal edge, and the distal edge being inclined rearwardly and inwardly toward the trailing face.

23. The rotary drill bit of claim 22 wherein the distal edge has a leading edge portion that is inclined rearwardly and inwardly toward the trailing face at a first angle of inclination and has a trailing edge portion that is inclined rearwardly and inwardly toward the trailing face at a second angle of inclination.

24. The rotary drill bit of claim 23 wherein the second angle of inclination is greater than the first angle of inclination.

25. The rotary drill bit of claim 13 wherein the elongate body including at least one dust collection opening.

26. A rotary drill bit insert comprising:

an elongate body rotatable about a central axis, the elongate body having a pair of symmetrical halves symmetrical about the central axis;

the elongate body containing a central notch disposed between the symmetric halves of the elongate body; and each symmetrical half comprising:

a leading face;

a top surface;

a leading cutting edge at the intersection of the leading face and the top surface; and the top surface being inclined in the radial direction from the central axis at a variable angle of inclination with respect to a second line normal to both a first radial line projecting from the central axis and the central axis.

27. A rotary drill bit comprising:

an elongate drill bit body having an axial forward end having attached there a rotary drill bit insert;

the rotary drill bit insert comprising:

an elongate body rotatable about a central axis, the elongate body having a pair of symmetrical halves symmetrical about the central axis;

the elongate body containing a central notch disposed between the symmetric halves of the elongate body; and each symmetrical half comprising:

a leading face;

a top surface;

a leading cutting edge at the intersection of the leading face and the top surface; and the top surface being inclined in the radial direction from the central axis at a variable angle of inclination with respect to a second line normal to both a first radial line projecting from the central axis and the central axis.

28. The rotary drill bit of claim 27 wherein the elongate drill bit body including at least one dust collection opening.

* * * * *